United States Patent [19]

Eriksson

[11] Patent Number: 4,857,180

[45] Date of Patent: Aug. 15, 1989

[54] ROTATING DISC SCREEN

[75] Inventor: Arne Eriksson, GustavsbergRuten, Sweden

[73] Assignee: Beloit Corporation, Beloit, Wis.

[21] Appl. No.: 160,741

[22] Filed: Feb. 26, 1988

[51] Int. Cl.[4] ..... B07B 1/26

[52] U.S. Cl. ..... 209/664; 209/297; 209/384; 209/389; 209/393

[58] Field of Search ..... 209/240, 284, 294, 297, 209/298, 379, 385, 389, 406, 407, 413, 659, 660, 664, 666, 288, 289, 384, 300, 293

[56] References Cited

U.S. PATENT DOCUMENTS

| | | | |
|---|---|---|---|
| 410,377 | 9/1889 | Rich | 209/384 X |
| 1,492,481 | 4/1924 | Robertson | 209/404 X |
| 2,533,357 | 12/1950 | Crawford | 209/284 X |
| 4,301,930 | 11/1981 | Smith | 209/671 |

FOREIGN PATENT DOCUMENTS

| | | | |
|---|---|---|---|
| 85043479 | 9/1985 | Sweden . | |
| 606637 | 5/1978 | U.S.S.R. | 209/289 |
| 2151947 | 7/1985 | United Kingdom | 209/288 |

*Primary Examiner*—Robert B. Reeves
*Assistant Examiner*—Gary C. Hoge
*Attorney, Agent, or Firm*—Dirk J. Beneman; Raymond W. Campbell

[57] ABSTRACT

A screening apparatus is provided having a plurality of axially aligned discs or rings which are lined up one behind the other, spaced a predetermined distance from each other and rotate as a single unit about a central longitudinal axis. A large central aperture is formed through each of the discs to form a tubular, drum type structure within which material to be separated is placed. Upon rotation of the tubular structure, acceptable material flows through the slots between adjacent discs while over-size material exits one open end of the tubular structure.

4 Claims, 2 Drawing Sheets

FIG. 1
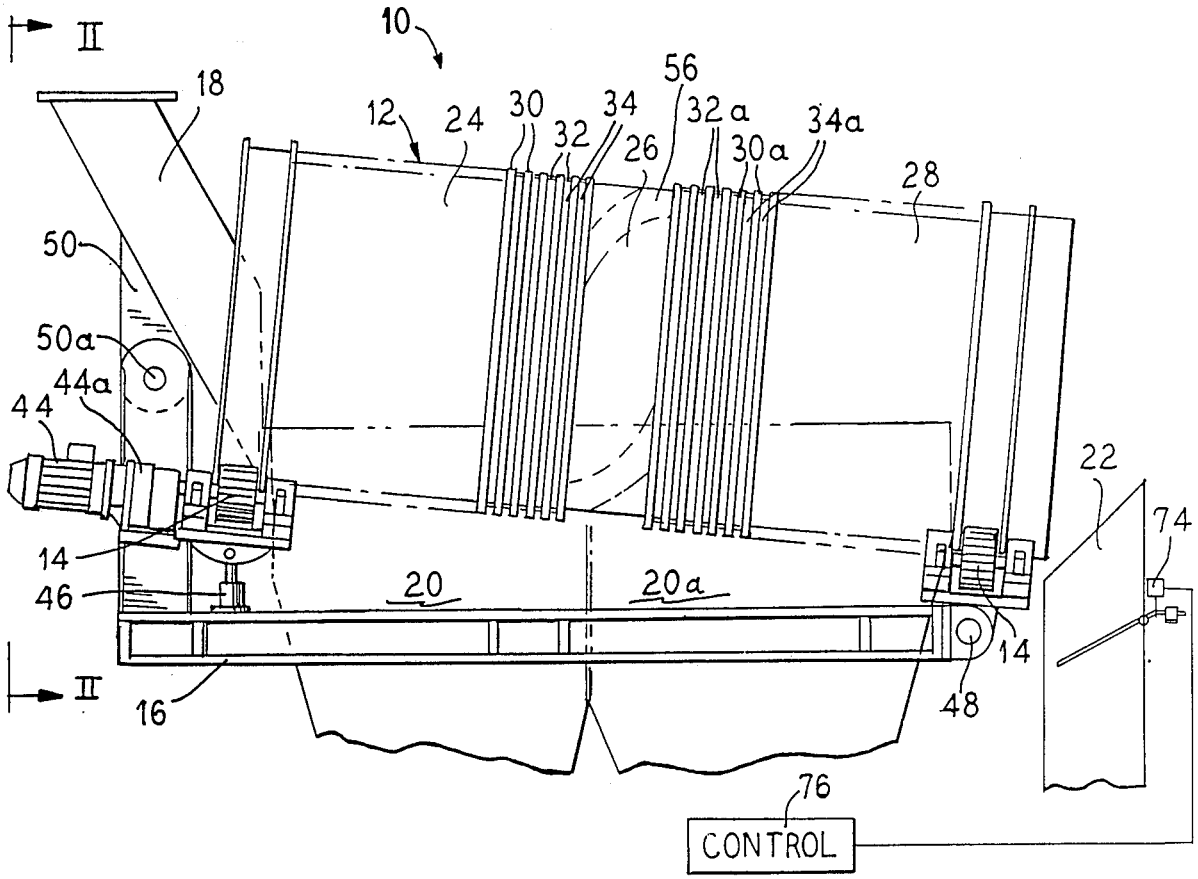
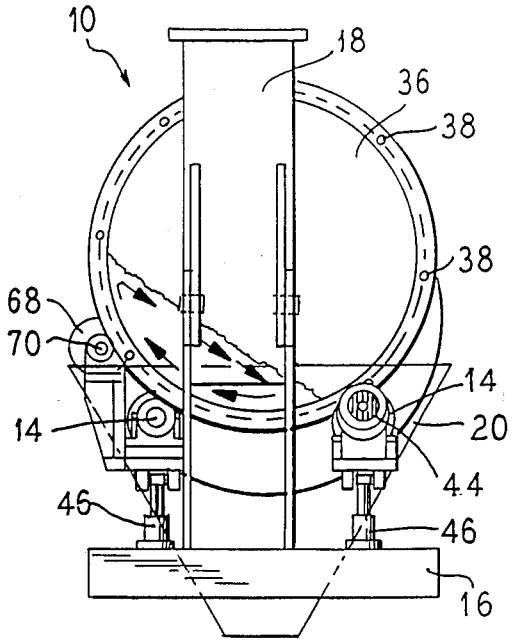
FIG. 2
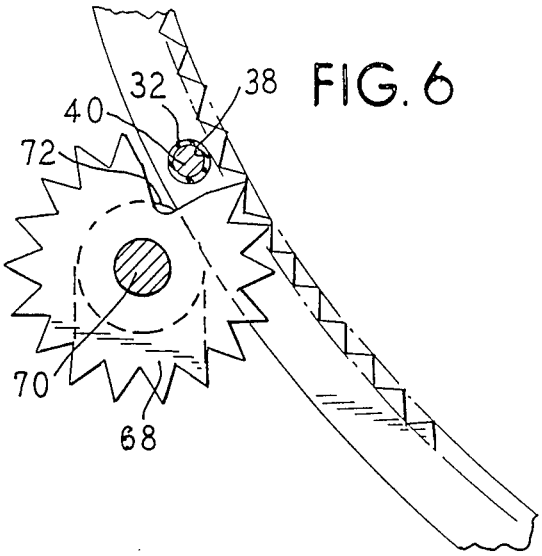
FIG. 6

ROTATING DISC SCREEN

FIELD OF THE INVENTION

The present invention relates to a separator and more particularly, but not by way of limitation, to a material separator for separating over-size material from material having a desired maximum size or consistency which incorporates a plurality of spaced apart, axially aligned discs or rings between which the desired material is filtered.

Disc separators can be used to process a variety of materials and have been used extensively in the paper industry where wood chips are effectively and efficiently screened to remove unacceptable dirt particles, over-size wood chips, rocks and other undesirable material.

PRIOR ART

Existing disc separators consist of a plurality of axially aligned flat discs which are formed into a number of separate units, each unit having its own central drive axis with a plurality of discs lined up on the central axis, one behind the other and completely encircling the axis. Each unit is in turn mounted next to another in a slightly staggered formation so that discs of alternate units fit within the gaps between the discs of adjacent units.

Material is fed onto the rotating disc units, with smaller material passing through the openings between the interdigitated discs of adjacent units while over-size material advances along the discs for collection. In some known separators, the general direction of material flow is parallel to the units' rotational axes while in others the flow is perpendicular. These existing disc separators, however, are complex, expensive, can readily become clogged and are not adjustable during operation. Furthermore, due to the critical interfitting between discs and the necessary slot widths, establishing and maintaining tolerances has become very difficult and normally requires a large amount of hand-fitting work.

Accordingly, the need has developed for a simple disc separator which does not become clogged, is less dependent on tight tolerances or continued adjustment, has adjustable slot widths and is adjustable during operation to control the flow of material through the separator.

SUMMARY OF THE INVENTION

According to this invention, there is provided an adjustable screening apparatus having a plurality of axially aligned discs spaced a predetermined longitudinal distance from each other to form slots between adjacent discs, and which discs rotate as one single unit about a central longitudinal axis. A large central aperture is formed through each of the discs, thereby forming a tubular or drum type structure, within which material to be separated is initially placed. Consequently, as the drum is rotated about its central longitudinal axis, material of a predetermined size is allowed to exit the drum through the slots provided between adjacent discs, while over-size material exits one open end of the drum.

Each of the discs has a plurality of apertures spaced along its outer periphery, and adjacent discs are spaced apart by tubular spacer members aligned with the peripheral apertures of the discs. Drawbars or rods extend through the aligned peripheral apertures and tubular spacer members to provide a singular, unitary structure. Additionally, in rotational connection with the exterior of the drum are a plurality of cleaning sprockets which extend into each slot between adjacent discs and rotate with the drum to remove material which may accumulate within the slots.

The material inlet end of the drum is somewhat elevated so that the material flows within the drum from inlet to over-size outlet as acceptable material exits through the slots between the discs. Over-size material exits the lower end of the drum for further processing.

At the over-size outlet end of the drum, a sensing means may be used to sense the flow rate of over-size material out of the drum. This sensing means in turn is connected to an adjustable jack means at the opposite, inlet end of the drum which automatically adjusts the height of the inlet end of the drum to provide increased or decreased material flow within the drum and past the sensing means.

BRIEF DESCRIPTION OF THE DRAWINGS

Best mode embodiments of the invention are shown in the attached sheets of drawings in which:

FIG. 1 is a side elevational view in partial schematic of the screening apparatus of the present invention;

FIG. 2 is an end elevational view taken along line II—II of FIG. 1;

FIG. 6 is an enlarged view of a disc and cleaning sprocket of the present invention.

DESCRIPTION OF THE PREFERRED EMBODIMENT

Figure 3:
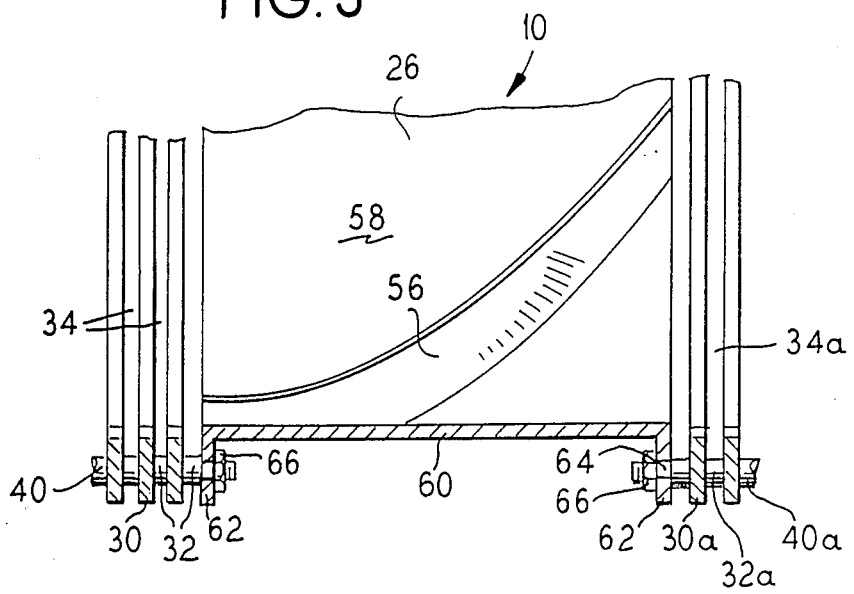
FIG. 3 is an enlarged fragmentary view of the central region of the device of FIG. 1, shown in partial cross-section.
Figure 4:
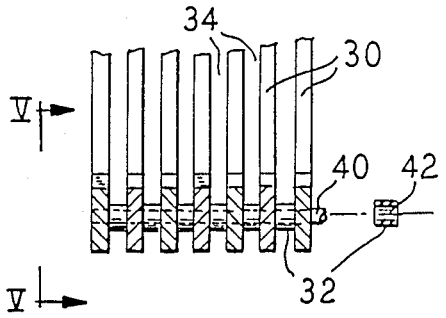
FIG. 4 is an enlarged fragmentary view of several of the disc members of the apparatus shown in FIG. 1.

The principles of the present invention are incorporated in a screening apparatus generally indicated by numeral 10 in the drawings.

Referring to FIG. 1, the screening apparatus 10 has a tubular shaped main body portion or drum 12 supported on a plurality of rollers 14 affixed to a base frame 16, and has a material inlet 18, a material collection chute 20 for accepted material and an outlet 22 for over-size material.

In the exemplary embodiment, the tubular shaped main body porion 12 is made up of three sections: an initial separation portion 24; a central mixing portion 26 and a final separation portion 28. The portions 24 and 28 are composed respectively of pluralities of discs 30 and **30*a* which are arranged in a side-by-side configuration along the length of each section and are separated from one another by pluralities of spacer members 32 and 32*a*, respectively, which form gaps or slots 34 and 34*a* between adjacent disc members 30 and 30*a*. It is to be understood that the tubular shaped main body portion 12** may be made up of a variety of sections of differing slot widths, and may omit a central mixing portion without departing from the teachings of the present invention.

For effective separation, the initial separation portion 24 has a gap or slot 34 which is slightly narrower than the slot 34*a* of the final separation portion 28. This design enables separation of raw material into different sizes, and, in the exemplary embodiment, slot 34 is approximately 6 mm and slot 34*a* is approximately 8 mm in width. It is to be noted, however, that different width dimensions may be used, and the apparatus 10 may be constructed with only one separation portion.

As FIGS. 1 through 5 illustrate, each of the discs 30 is a ring-like structure having a large central aperture 36. The discs 30 are held together in a unitary structure by further having a plurality of smaller apertures 38 located around the periphery of each of the discs 30 through which a plurality of circumferentially spaced longitudinally extending drawbars or elongated rods 40 are inserted and are affixed at the longitudinal ends of the tubular shaped main body portion 12.

In the exemplary embodiment, each of the spacer members 32 has a central aperture 42 through which the drawbars 40 may be passed when affixing the discs 30 together. Alternatively, the spacer members 32 may be resilient members such as springs, spring washers, rubber or any other type of resilient member to provide adjustability of the slots 34, and may be made in any desired shape and affixed in a variety of manners so long as the necessary slot 34 is provided between adjacent discs 30.

As FIGS. 1 and 2 show, the tubular shaped main body or drum portion 12 is supported by the plurality of rollers or wheels 14 which in turn are affixed to the base support member or frame 16. In the exemplary embodiment, at least one of these rollers 14 will be connected to a drive motor 44 by a gear system generally indicated at 44*a*, for example, which will provide rotation of the tubular shaped main body portion 12 about its central longitudinal axis. Alternatively, several drive motors 44 may be used in conjunction with a desired number of rollers 14 which may be driven in a number of ways without departing from the teachings of the present invention.

As FIG. 1 illustrates, the inlet end of the tubular shaped main body portion 12 is slightly elevated with respect to the other end. At least one jack member 46, which may be mechanically, pneumatically or hydraulically adjustable, is provided to increase or decrease the slope of the drum to the extent desirable for the conditions and type of material being screened. Furthermore, at the over-size outlet end of the tubular shaped main body portion 12 the roller supports 14 are affixed to the base support member 16 with a hinge member 48. Adjustment of the jack 46 will be explained in greater detail hereinafter.

In the exemplary embodiment, four rollers 14 are employed, two at each end of the tubular shaped main body portion 12, while one motor 44 and two jack members 46 are arranged at the inlet end of the tubular shaped main body portion 12.

A material inlet spout 18 is provided at the inlet end of the tubular shaped main body portion 12. The spout 18 receives raw material to be screened and directs it into the center of the tubular shaped main body portion 12. The screening apparatus of the present invention may be used to screen various materials including rocks, gravel or any other desired material, and in the exemplary embodiment wood chips are processed in order to separate over-size or undesired material from the chip stream.

The spout 18 is generally tubular in shape and is supported by a supporting member 50 which is affixed to the base support member 16. As FIGS. 1 and 2 illustrate, the supporting member 50 provides support and accommodates vertical adjustment of the spout 18 by having a pivot 50*a* about which the spout 18 rotates to raise and lower the spout 18 to correspond to the vertical elevation of the tubular shaped main body portion 12.

Along the entire length of the tubular shaped main body or drum portion 12 is a material collection chute 20 which is somewhat wider than the outside diameter of the tubular shaped main body portion 12. The material collection chute 20 collects accepted material which has travelled between the discs 30 through the slots 34. This material may then be funneled into a desired container or conveying apparatus (not shown) by the material collection chute 20 and removed for further processing. According to the design of the tubular shaped main body portion 12 of the exemplary embodiment, the chute 20 is divided into two sections 20 and 20*a* to independently collect the material of different sizes as the material exits the initial separation portion 24 and the final separation portion 28.

On the end of the tubular shaped main body portion 12 near the hinge 48, an over-size material collection spout 22 is provided. Spout 22 is used to collect material which is too large to fit between the discs 30 through the slots 34. The over-size material is transferred to another container or conveying apparatus (not shown) for further processing.

Figure 5:
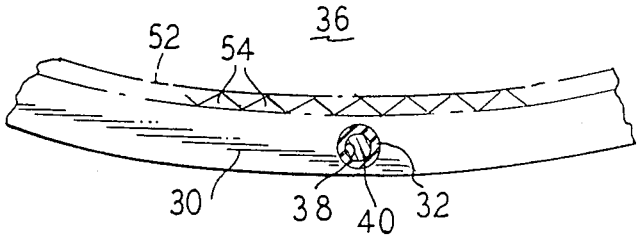
FIG. 5 is an enlarged fragmentary view taken along line V—V of FIG. 4.

As FIGS. 5 and 6 illustrate, the inside diameter 52 of each of the discs 30 is formed with a plurality of teeth 54. The teeth 54 provide a mixing motion within the material to be separated, as illustrated by the arrows in FIG. 2, to provide proper orientation and separation of the material during rotation of the tubular shaped main body portion 12.

To further aid in mixing, a blade 56 may be placed in the central mixing portion 26 of the tubular shaped main body portion 12 or in any other desired section. As FIGS. 1 and 3 illustrate, mixing blade 56 has a large central aperture 58 and contacts the entire inside diameter of the central mixing portion 26. The mixing blade 56 is affixed at an angle with respect to the transverse dimension of the tubular shaped main body portion 12, and, during rotation, this mixing blade 56 stirs up the material to enhance further separation in the final separation portion 28. Alternatively, the mixing blade 56 may be replaced with a plurality of pins (not shown) which are affixed to the inner wall of the central mixing portion 26. The mixing blades, pins or the like are provided to disrupt the flow patterns of material in the separator, thereby reorienting the material and ensuring that all material is subjected to proper screening.

As FIG. 3 illustrates, the central mixing portion 26, which contains the mixing blade 56, includes a circular imperforate tubular portion 60 forming the outside housing of the tubular shaped main body portion 12. The exterior ends of the tubular portion 60 are formed with flanges 62 having apertures 64 through which the drawbars 40 extend, the drawbars 40 being secured at the interior sides of the flanges 60 with nuts 66. In FIG. 3, two drawbars 40 and 40*a* are shown joining the three sections 24, 26 and 28 together; however, it should be realized that a plurality of such drawbars are provided, spaced about the apparatus.

As FIG. 6 shows, a plurality of toothed rotary discs or sprockets 68 are placed within each gap 34 to dislodge material which may accumulate between the discs 30. Each of the sprockets 68 rotates about a central axis 70 and has a recess 72 so that the drawbars 40 and spacer members 32 may pass during rotation of the tubular shaped main body portion 12. Accordingly, the rotational speed and diameters of the sprockets 68 are selected with respect to the rotational speed of the tubular shaped main body portion 12 and the drawbar spacing so that the sprockets 68 make at least one full revolution between each drawbar 40 in order for each drawbar 40 and spacer 32 to be received in the recess 72. As FIG. 2 shows, the sprockets 68 may be connected to be driven with the roller wheel 14 such as by a belt or chain (not shown), may be independently driven by their own motors (not shown) or may be rotated by the tubular shaped main body portion 12 itself.

Figure 7:
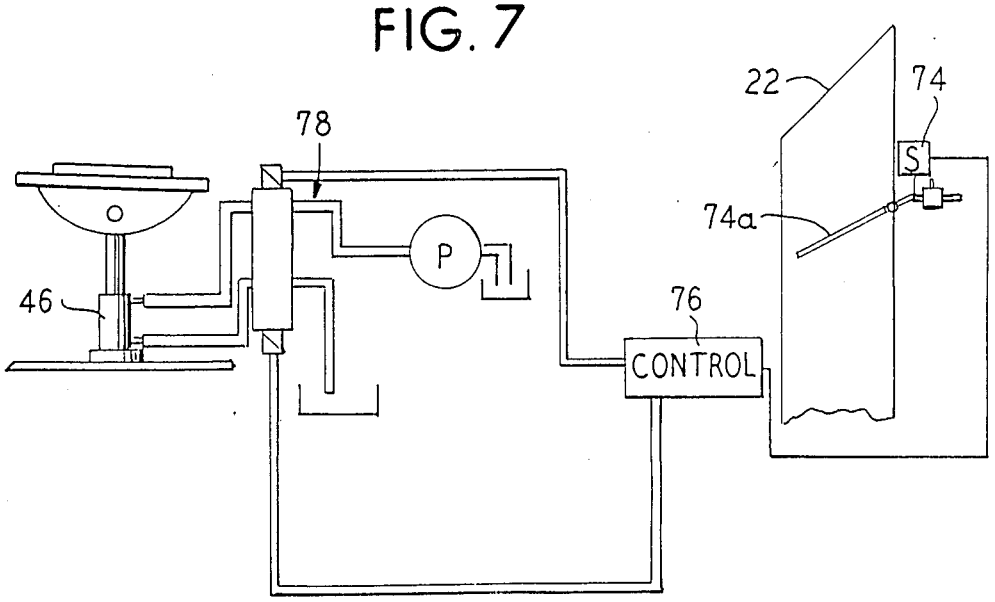
FIG. 7 is a schematic of the sensor and jack control system of the present invention.

As shown in FIGS. 1 and 7, a sensor 74 is employed within the over-size material collection spout 22 and is part of a feedback system to control the slope of the tubular shaped main body system to control the slope of the tubular shaped main body portion 12 during operation. Sensor 74 provides information to a control circuit 76 which in turn controls the height of the jack 46 by adjusting the hydraulic flow through its hydraulic system generally indicated at 78. With this feedback system, the height of one end of the tubular shaped main body portion 12 may be adjusted so that a desired flow of over-size material exits through the over-size material collection spout 22 which would provide a desired flow rate within the tubular shaped main body portion 12 itself. In the exemplary embodiment, the sensor 74 is shown with a switch arm **74*a* which contacts material within the chute 22**, but may be any type of suitable sensing mechanism.

In operation, material to be separated is fed into the inlet spout 18 which funnels the material into the center of the tubular shaped main body portion 12. Rotation of the tubular shaped main body portion 12 provides mixing of the material while permitting acceptable material to flow through the gaps 34 between the discs 30 to be collected in the material collection chute 20. At the same time, due to the elevation of the tubular shaped main body portion 12, the material flows downwardly towards the exit end to be collected in the over-size material collection spout 22. In the exemplary embodiment, the material first flows through the initial separation portion 24, which separates smaller material, then passes into the central mixing portion 26, to provide increased mixing, and then enters the final separation portion 28. During this process, the sensor 74 is regulating the flow of material through the tubular shaped main body portion 12 by adjusting its elevation.

As the tubular shaped main body portion 12 is rotated, the toothed rotary discs or sprockets 68 rotate within each gap 34 to dislodge material which may accumulate between adjacent discs 30. As the sprockets 68 rotate, the drawbars 40 and spacer members 32 are received in the recess 72 of each sprocket 68 so that the sprockets 68 may rotate with the tubular shaped main body portion 12.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A screening apparatus which comprises;

a plurality of longitudinally spaced rings defining a hollow drum with spaced circumferential slots of selected width between said rings to pass particles of a desired size;

inlet means for feeding material to be screened into one end of said drum;

over-size outlet means for receiving material too large to pass through said slots from the other end of said drum;

accept outlet means along the length of said drum for collecting screened material passing through said circumferential slots;

drive means for rotating said drum including means rotatably mounting said drum at both ends thereof;

adjusting means for raising and lowering said mounting means at one end of said drum; and a sensor receiving outflow from said drum for regulating said adjusting means to control the rate of flow through said drum.

2. The apparatus of claim 1 wherein an imperforate tubular section is disposed intermediate the ends of said drum and divides said plurality of rings into separate screening sections, and a mixing means is disposed in said imperforate tubular section for disrupting the flow of material through said drum.

3. A screening apparatus comprising:

a plurality of axially aligned longitudinally spaced discs, said discs having a large central aperture defining a hollow drum with spaced circumferential slots of selected width between said discs to pass particles of a desired size;

spacer means between adjacent discs for providing said slots between said discs;

means for affixing said plurality of discs and said spacer means into a drum;

means for rotating said drum about its central longitudinal axis;

inlet means for receiving and delivering material to be separated into one end of said drum;

outlet means for receiving non-acceptable material at the other end of said drum;

means for receiving accepted material along the exterior longitudinal length of said drum, whereby said accepted material passes through the slots between said discs while said drum is rotating;

jack means at one end of said drum for elevating said drum; and sensor means at said outlet means for sensing material flow rate through said outlet means, said sensor means being connected to a feedback control system which is capable of adjusting said jack means to provide the proper material flow rate through said apparatus and said outlet means.

4. An adjustable disc separator apparatus for separating material comprising:

a base member;

a plurality of axially aligned longitudinally spaced discs, each of said discs having a large central aperture, said apertures having a toothed inner surface, each of said discs including a plurality of apertures located along its outer periphery;

spacer means between adjacent discs for providing a desired slot between discs, said spacer means having an aperture and being resilient in order to provide adjustability of said slot;

a plurality of circumferentially spaced longitudinally extending drawbars for affixing said plurality of discs and said spacer means into a hollow drum having circumferential slots of selected width between said discs to pass particles of a desired size, said drawbars being inserted through said peripheral apertures of said discs and through said apertures of said spacer means and being fastened at both ends of said drum;

rotational support means for supporting and rotating said drum about its central longitudinal axis, said rotational support means being driven by a motor means and being affixed to said base member;

elevating means for elevating one end of said drum;

inlet means on one end of said drum for receiving material to be separated, said inlet means being positioned to direct material into said tubular structure, said inlet means being adjustably supported;

outlet means on the other end of said drum for receiving over-size material from said drum, said outlet means having a sensor means for sensing material flow rate, said sensor means being connected to a feedback control system capable of adjusting said means for elevating to provide the proper flow rate through said drum;

a plurality of cleaning sprockets rotatably in communication with each slot from the exterior of said drum between said plurality of discs for dislodging material within said slots, each of said sprockets having a recess for accepting a drawbar upon its rotation about the periphery of said drum;

hinge means for hingedly affixing said drum to said base member at its end opposite said elevating means, said hinge means being affixed to said base member and said rotational support means; and means for receiving accepted material along the exterior longitudinal length of said drum, whereby said accepted material passes through said slots between said discs while said drum is rotating, and is received in said means for receiving.

* * * * *